US006295946B1

(12) United States Patent
Kasik

(10) Patent No.: US 6,295,946 B1
(45) Date of Patent: Oct. 2, 2001

(54) SIGNALING DEVICE FOR USE WITH A CONTAINER

(75) Inventor: John P. Kasik, Dallas, TX (US)

(73) Assignee: Cardinal Automation, Inc., Dallas, TX (US)

( * ) Notice: Subject to any disclaimer, the term of this patent is extended or adjusted under 35 U.S.C. 154(b) by 0 days.

(21) Appl. No.: 09/465,162

(22) Filed: Dec. 16, 1999

(51) Int. Cl.[7] ..... B65F 1/00
(52) U.S. Cl. ..... 116/303; 116/215; 220/908
(58) Field of Search ..... 116/303, 215, 116/284, 306, 307, 309, 319, 173; 220/908, 831, 832, 810; 206/459.1; 215/230; 232/35

(56) References Cited

U.S. PATENT DOCUMENTS

| | | | | |
|---|---|---|---|---|
| 795,239 | * | 7/1905 | Smith | 232/35 |
| 926,613 | | 6/1909 | Sheets et al. . | |
| 1,173,134 | * | 2/1916 | Whitney | 220/831 |
| 1,512,337 | * | 10/1924 | Jackson | 232/35 |
| 2,444,679 | * | 7/1948 | Shaukis | 116/319 |
| 3,137,408 | * | 6/1964 | Taylor | 220/326 |
| 4,241,846 | * | 12/1980 | Murphy | 220/318 |
| 4,363,439 | | 12/1982 | Manian . | |
| 4,655,390 | | 4/1987 | Martin . | |
| 4,836,394 | * | 6/1989 | Glomski | 220/831 |
| 4,860,267 | | 8/1989 | Herrington et al. . | |
| 5,465,841 | | 11/1995 | Wilson et al. . | |
| 5,524,818 | | 6/1996 | Patry et al. . | |
| 5,560,540 | | 10/1996 | Amendola . | |
| 5,595,317 | * | 1/1997 | Hodge | 220/831 |
| 5,634,589 | | 6/1997 | Greene . | |
| 6,092,690 | * | 7/2000 | Bitowft et al. | 220/831 |

* cited by examiner

*Primary Examiner*—Andrew H. Hirshfeld
(74) *Attorney, Agent, or Firm*—Gary M. Cohen

(57) ABSTRACT

A signaling device is mated with a conventional container to develop a change in state for indicating that the container has been accessed. In conjunction with a refuse container having a body and a cover connected to the body of the container by a hinge, the signaling device takes the form of a flag which is coupled with the hinge of the container so that the flag can move between a lowered position in which the flag lies over the cover of the container, and a raised position in which the flag extends upwardly from the container, providing the desired change in state. In use, the flag is automatically moved from the lowered position to the raised position when the cover is opened, signaling that the container has been accessed. The flag is automatically returned from the raised position to the lowered position as part of the procedure which is used to later empty the container. The signaling device can then be used to identify only those containers which have been accessed so that only those containers having a signaling device which indicates that the particular container has been accessed are emptied.

25 Claims, 7 Drawing Sheets

SIGNALING DEVICE FOR USE WITH A CONTAINER

BACKGROUND OF THE INVENTION

The present invention generally relates to a device for automatically signaling whether a particular container has been accessed, primarily for purposes of identifying containers which call for service subsequent to such access.

It is common practice in any of a variety of endeavors to station one or more containers at various locations for purposes of receiving and/or storing desired articles at each such location. For example, in conjunction with the collection of refuse, common practice is to station containers at each of a plurality of sites so that subscribers to the collecting service can deposit refuse in their respective containers for subsequent collection, usually according to a pre-established schedule. The collection service then takes appropriate steps, according to the established schedule, to empty the containers of its subscribers and to remove the contents for disposal.

A common practice for emptying the containers of their contents is to employ a service vehicle which includes a hopper for receiving the contents of the containers, and a lifting mechanism for engaging each of the several containers and for lifting the engaged container to the hopper. In the course of lifting the container to the hopper, steps are taken to invert the container so that its contents fall into the hopper under the influence of gravity. This is often facilitated by providing the lifting mechanism and the container with cooperating structures which enable the operator to perform the desired operations remotely, from the service vehicle.

Such a procedure can be quite efficient since the entire operation can be performed remotely, by a single operator driving the service vehicle. However, in the course of such operations, it is not uncommon for the operator to perform the scheduled operations on empty containers (e.g., on containers which have not been used since the last scheduled pick-up). This can tend to limit the overall efficiency of the operation, in turn contributing to unnecessary costs (e.g., labor costs, fuel costs, etc.).

It will be appreciated that other industries making use of containers for any of a variety of diverse purposes will tend to experience similar difficulties, as well as other problems which would benefit from an efficient device for indicating whether a container has been accessed.

SUMMARY OF THE INVENTION

Accordingly, it is the primary object of the present invention to provide a device for signaling that a container has been accessed.

It is also the object of the present invention to provide a device for automatically signaling that a container has been accessed.

It is also the object of the present invention to provide a simple, reliable and low-cost device for automatically signaling that a container has been accessed.

These and other objects which will become apparent are achieved in accordance with the present invention by providing a signaling device which is mated with an otherwise conventional container to develop a change in state which is indicative of access to the container.

In conjunction with a refuse container having a body and a cover connected to the body of the container by a hinge, the signaling device preferably takes the form of a flag, one end of which is coupled with the hinge of the container. The hinged connection allows the flag to move between a lowered position in which the flag lies over the cover of the container, and a raised position in which the flag extends upwardly from the container.

Resulting from interaction between the flag and the cover, the flag is automatically moved from the lowered position to the raised position as the cover is opened, signaling that the container has been accessed. The flag is further automatically returned from the raised position to the lowered position when the container is emptied. For cases where the container is emptied by lifting the container to the hopper of a service vehicle, inversion of the container operates to return the flag to the lowered position after the container has been emptied.

The signaling device of the present invention can similarly be adapted to other types of containers, having uses other than refuse collection, for providing a positive indication that the particular container has been accessed.

In each case, this then allows an operator to empty only those containers having a signaling device which indicates that the particular container has been accessed, requiring the operator to empty only those containers likely to have contents and allowing the operator to bypass those containers showing no sign of having been accessed since the container was last emptied. This, in turn, allows the operator to proceed at a more rapid and efficient overall pace.

For further detail regarding a preferred implementation of the present invention, reference is made to the detailed description which is provided below, taken in conjunction with the following illustrations.

DETAILED DESCRIPTION OF A PREFERRED EMBODIMENT

Figure 1:
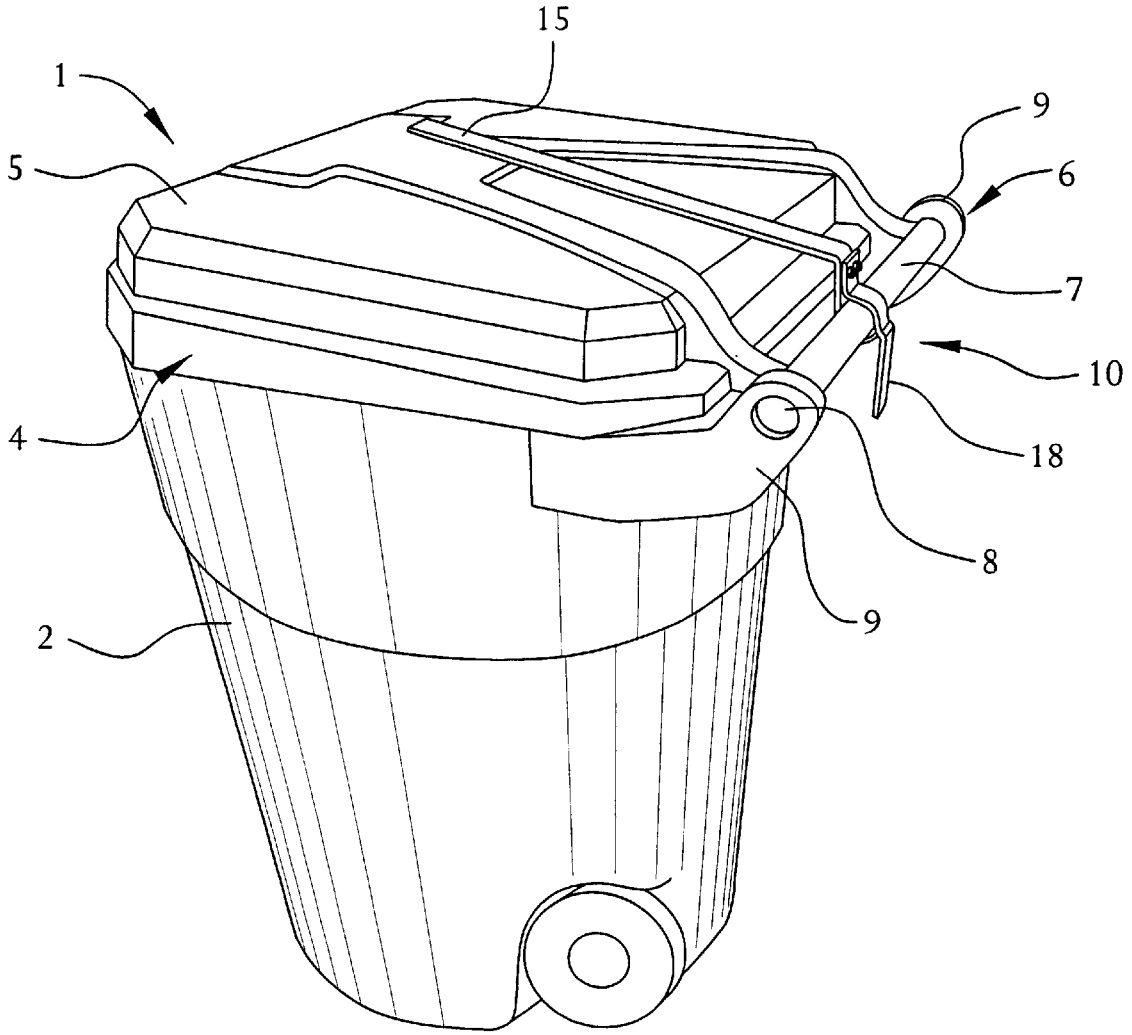
FIG. 1 is an isometric view of a container provided with a signaling assembly produced in accordance with the present invention, with the cover of the container in a closed position.

FIG. 1 shows a container 1 which has been fitted with a signaling assembly 10 produced in accordance with the present invention. It will be recognized that the container 1 selected for illustration in the drawings is of a type commonly used for containing refuse which is to be collected by a servicing agency. It is to be understood that the container 1 has been selected only for purposes of illustration, and that the improvements of the present invention may similarly be used with any of a number of different refuse container designs, as well as any of a variety of container designs which are useful for purposes other than refuse collection.

The container 1 is itself entirely conventional, corresponding to any of a variety of known container designs, and generally includes a body 2 for receiving contents through an opening 3 (see FIG. 3) defined in upper portions 4 of the container 1, and a cover 5 for enclosing the opening 3 so that the contents of the container are appropriately secured within the container 1. The cover 5 is connected to the body 2 of the container 1 by a hinged connection, at 6, which preferably incorporates the handle 7 which is conventionally provided for use in maneuvering the container 1. Ends 8 of the handle 7 are advantageously engaged by a pair of journals 9 extending from the body 2 of the container 1 so that the cover 5 can be rotated about the hinged connection 6 relative to the body 2 of the container 1.

In accordance with the present invention, the container 1 is fitted with a signaling assembly 10 which is operatively coupled with the handle 7 of the hinged connection 6. To this end, and referring to FIG. 2, the signaling assembly 10 is preferably formed from a pair of band sections 11, 12, which are joined to engage the handle 7. The band section 11 includes a curved segment 13 having a radius for cooperating with the handle 7, a mounting bracket 14 which extends from the curved segment 13, and a flag 15 which extends from the mounting bracket 14. The band section 12 similarly includes a curved segment 16 having a radius which corresponds to the radius of the curved segment 13. The curved segment 16 further includes a mounting bracket 17 at one end, for cooperating with the mounting bracket 14 of the band section 11, and a stop 18 at the other end, for interacting with the body 2 of the container 1 as will be further described below.

Figure 2:
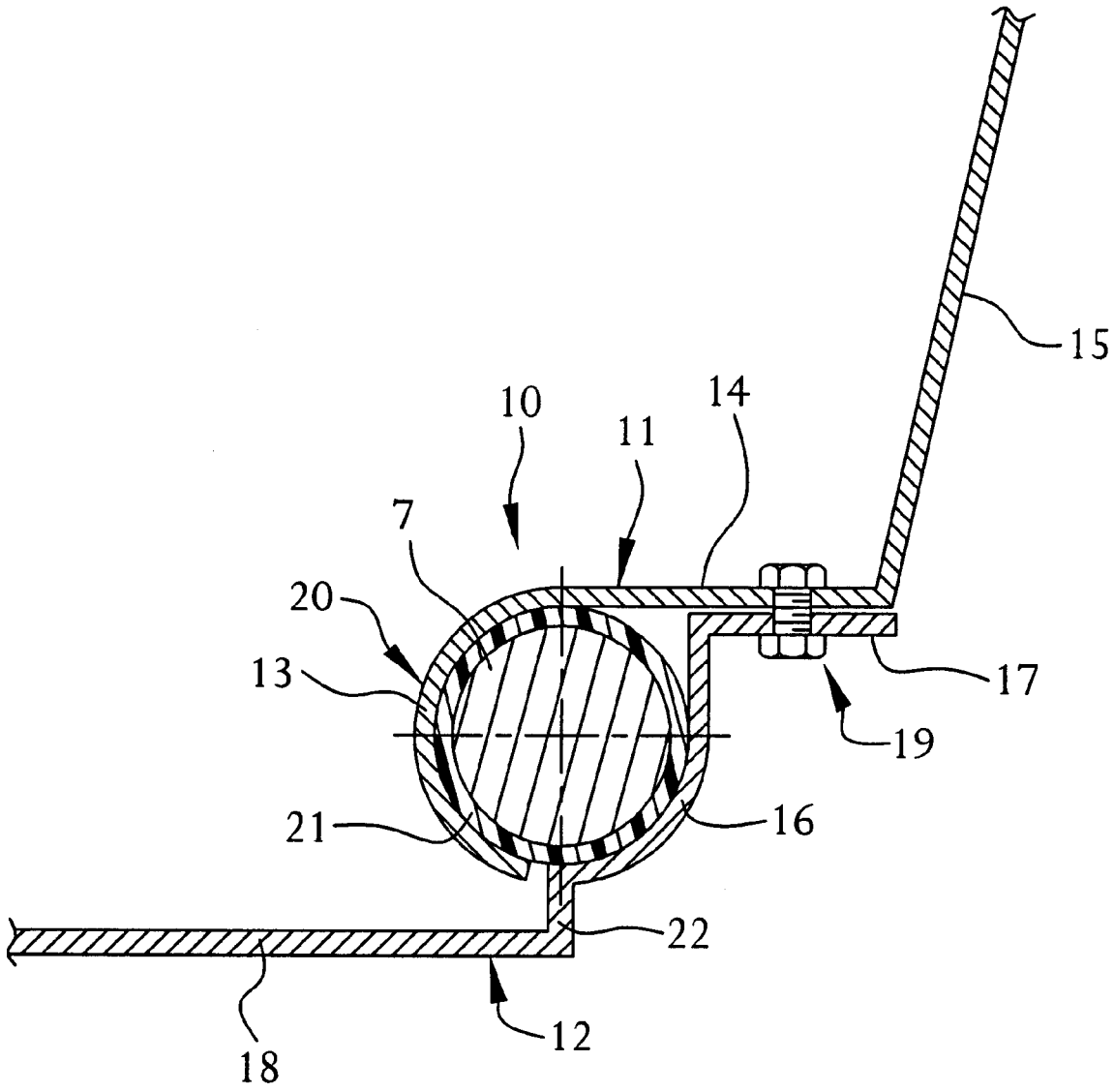
FIG. 2 is a cross-sectional view of the signaling assembly of FIG. 1, coupled with the hinge of the container which joins the cover to the body.

The band section 11 is positioned to oppose the band section 12, so that the curved segment 13 and the curved segment 16 can cooperate to surround and engage the handle 7. Suitable attachment hardware 19 (e.g., the nut and bolt shown) is then used to connect the mounting bracket 14 of the band section 11 with the mounting bracket 17 of the band section 12, forming an attachment assembly 20 which surrounds and engages the handle 7 of the hinged connection 6. Resulting from such assembly, the flag 15 is caused to project outwardly from one end of the attachment assembly 20 and the stop 18 is caused to project outwardly from the opposite end of the attachment assembly 20, as is best shown in FIG. 2.

The radius for the curved segments 13, 16 is preferably selected so that the joined structures will slidingly engage the handle 7. A grommet 21 can be positioned between the handle 7 and the joined curved segments 13, 16, if desired, to protect the handle 7. If used, the grommet 21 is preferably formed of a resilient rubber or plastic material. However, use of the grommet 21 is presently considered less preferred since it can introduce a limited degree of resistance between the signaling assembly 10 and the handle 7.

Both the flag 15 and the stop 18 will have a size and a configuration which will vary depending upon the size and the configuration of the container with which the signaling assembly 10 is to be mated. For the container 1, and as an example, the flag 15 includes an offset (the mounting bracket 14) which tangentially extends from the center of the handle 7 for about 2.5 inches, and projects at an angle (an obtuse angle, e.g., 105°) from the mounting bracket 14 for a length of about 20.0 inches. The stop 18 includes an offset 22 which radially projects from the handle 7 for about 0.5 inches, and projects at a right angle from the offset 22 for a length of about 4.25 inches. Such dimensions are preferred to permit the signaling assembly 10 to effectively interact with the existing structures of the container 1 as will be discussed more fully below. For this reason, the foregoing parameters should be considered as illustrations only, with the understanding that such parameters may be freely varied to cooperate with the particular container with which the signaling assembly 10 is to be used.

Operation of the foregoing structures will now be described with reference to FIGS. 1 through 5. Generally speaking, the container 1 will be stationed at a given location for a particular subscriber to the refuse removal service. The cover 5 will be positioned over the container 1 to maintain deposited items within the container 1.

Figure 3:
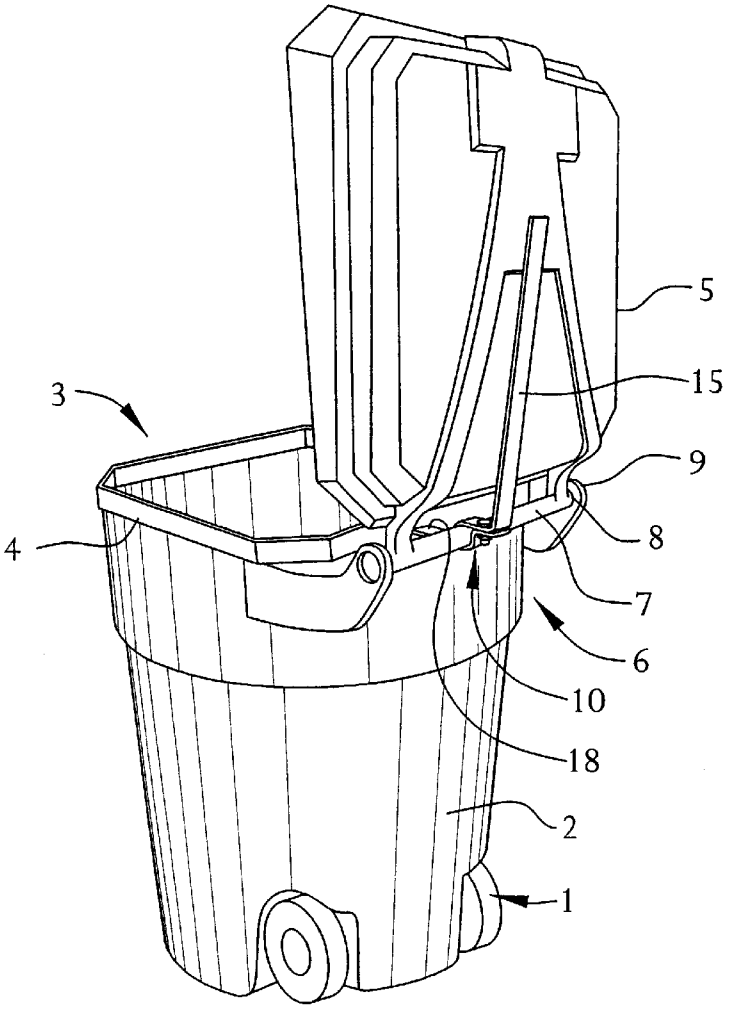
FIG. 3 is an isometric view of the container of FIG. 1, with the cover of the container in an opened position.

In accordance with the present invention, the flag 15 of the signaling assembly 10 will initially assume the lowered positioned shown in FIG. 1, lying over the cover 5 of the container 1. To deposit refuse in the container 1, the usual steps will be taken to raise the cover 5, as shown in FIG. 3. As the cover 5 is lifted, the flag 15 of the signaling assembly 10 will be engaged by the surface of the cover 5, automatically moving the flag 15 to its raised position. Contact between the stop 18 and the body 2 of the container 1 operates to limit movement of the flag 15 so that the raised flag 15 will maintain a generally vertical orientation.

Figure 4:
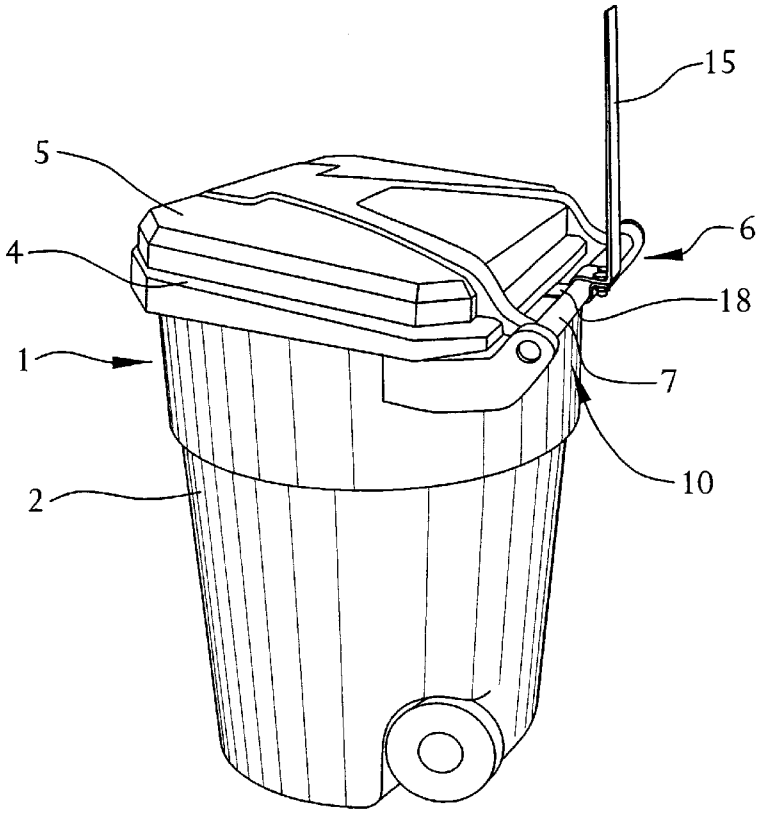
FIG. 4 is an isometric view of the container of FIG. 1, with the cover of the container returned to the closed position after having been opened.

Resulting from the configuration of the signaling assembly 10, the weight of the flag 15 will cause the signaling assembly 10 to remain in the raised position after the cover 5 has been closed. The flag 15 will be retained in this raised (i.e., generally vertical) orientation responsive to contact between the stop 18 and the body 2 of the container 1. As a result, and as is best shown in FIG. 4, the flag 15 will remain vertical when the cover 5 is replaced over the container 1, providing a clear and positive indication that the container 1 has been accessed. This indication is given automatically, resulting from normal use of the container 1, and no positive intervention is required to raise the flag 15 and notify the refuse removal service that the container 1 has been accessed.

The refuse removal service will provide (generally according to a prearranged schedule) a suitable service vehicle for emptying the various containers of its subscribers, and the operator of the service vehicle will follow a prearranged route for accessing and emptying the subscribers' containers. However, in accordance with the present invention, the operator is provided with the ability to visually identify the containers which have been accessed since the particular route was last serviced by visually identifying those containers having a raised flag 15. In this way, only those containers requiring service need be operated upon. Any containers having a flag 15 which remains in the lowered position can be bypassed, saving both time and labor costs.

Figure 5A:
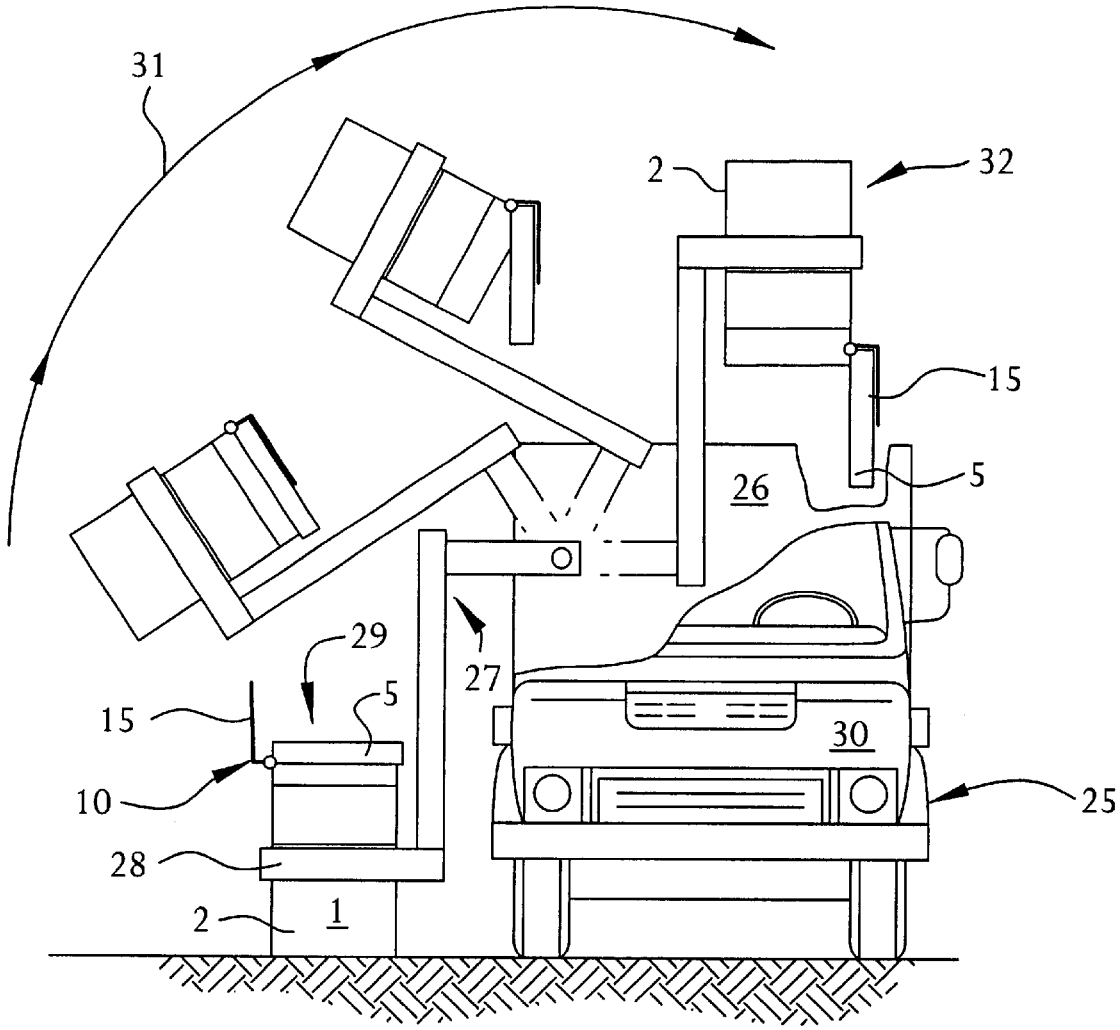
FIGS. 5A, 5B, 6A and 6B are sequential, schematic views showing operation of the signaling assembly of the present invention while the container is being emptied by a service vehicle.

FIG. 5A schematically illustrates the sequence of steps that will ordinarily be performed to empty a container 1 having a raised flag 15. To this end, let it be assumed that the service vehicle is a truck 25 having a hopper 26 for receiving refuse, and a mechanism 27 for remotely engaging a container and for lifting the engaged container to the hopper 26 so that the contents of the container can be discharged into the hopper 26. Initially, the operator will position the truck 25 so that a pair of claws 28 associated with the lifting mechanism 27 can engage the container 1 to be emptied, as is schematically shown at 29. This is conventionally done by positioning the body 2 of the container 1 between the pair of claws 28 so that the claws 28 can be closed over the body 2 of the container 1.

The lifting mechanism 27 is then activated by the operator (remotely, from the cab 30 of the truck 25), to lift the engaged container 1 to the hopper 26. This causes the container 1 to proceed along the path 31, until such time as the container 1 is brought to the position 32. In the position 32, the container 1 is inverted over the hopper 26, with the cover 5 extending downwardly under the influence of gravity. The flag 15 of the signaling assembly 10 will also extend downwardly, under the influence of gravity, keeping the flag 15 free and clear of the refuse which is being discharged from the container 1.

Figure 5B:
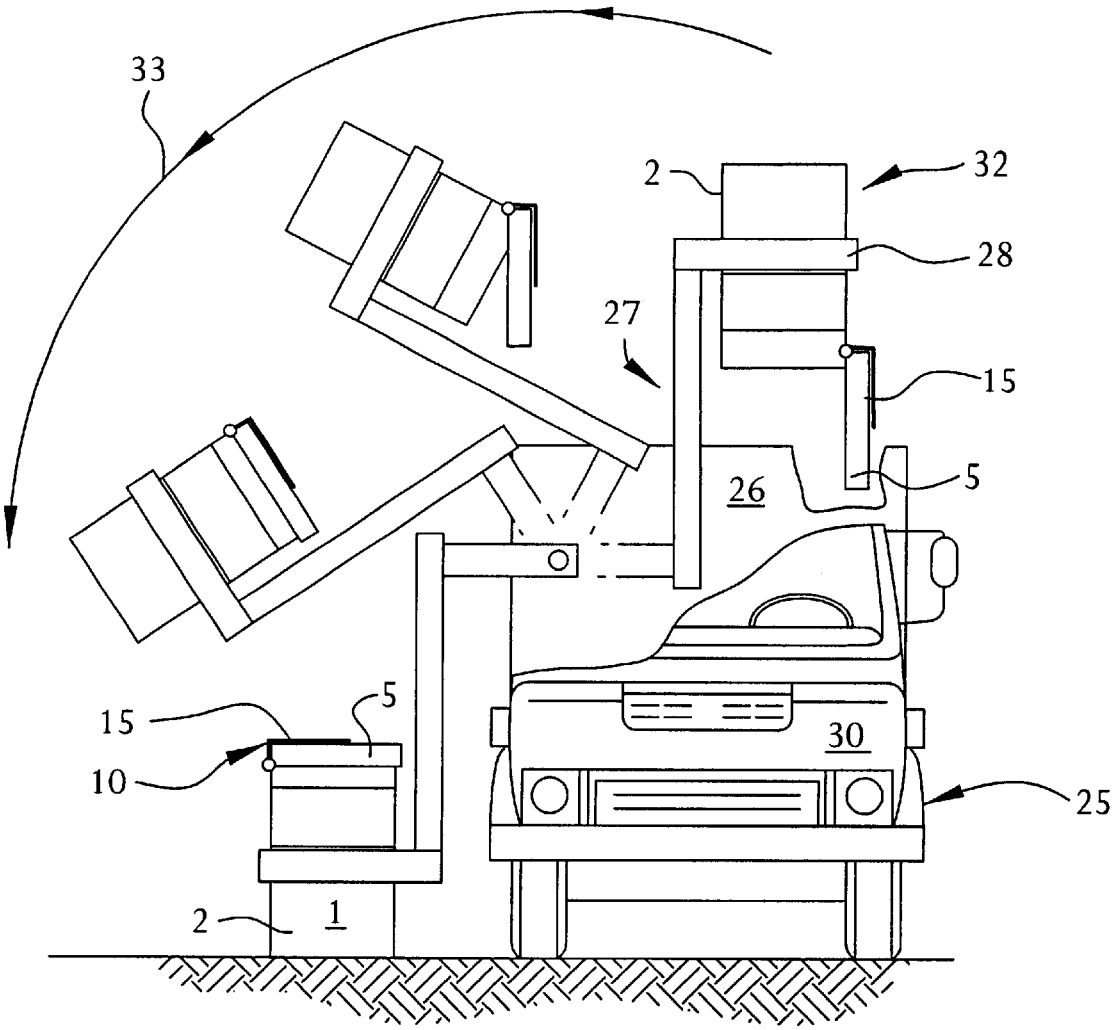

Referring now to FIG. 5B, the emptied container 1 is then returned to its initial position by the lifting mechanism 27. In the course of this transfer, along the path 33, the cover 5 of the container 1 is caused to return to a position enclosing the opening 3 of the container 1. The configuration of the signaling assembly 10 similarly causes the flag 15 to return to its initial, lowered position (with the flag 15 lying over the cover 5). Again, the return of the flag 15 to its initial position takes place automatically, without requiring any intervention by the operator, or the subscriber to the refuse removal service. The container 1 is then ready to receive future contents. If so, the flag 15 will again be raised, signaling for a future emptying procedure. If not, the flag 15 will remain lowered, signaling the operator that the container 1 can be bypassed. As a result, the operator need only take steps to empty those containers which require attention, saving both time and labor, and their associated costs.

As previously indicated, the signaling assembly 10 of the present invention can be used with any of a variety of different types of containers (including refuse containers and containers for use in applications other than the handling of refuse). As an example, FIGS. 6A and 6B show use of the signaling assembly 10 of the present invention with a container 35 of a type which is commonly used for handling commercial refuse.

Figure 6A:
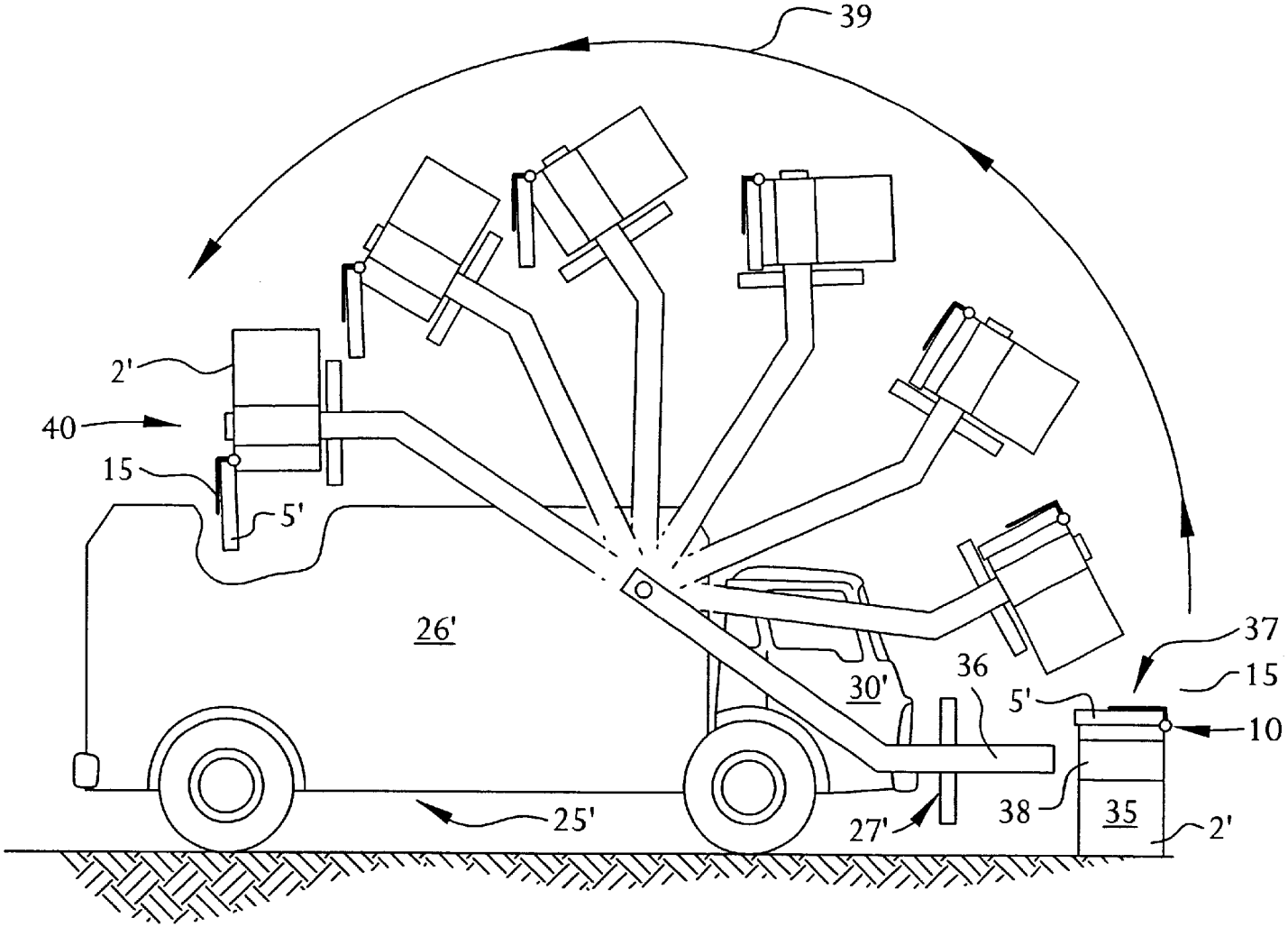

FIG. 6A schematically illustrates the sequence of steps that will ordinarily be performed to empty the container 35, again, only for those containers with a raised flag 15. In this case, the service vehicle is a truck 25' having a hopper 26' for receiving refuse, and a mechanism 27' for remotely engaging the container 35 and for lifting the engaged container 35 to the hopper 26' so that the contents of the container 35 can be discharged into the hopper 26'. To this end, the operator will initially position the truck 25' so that a pair of tines 36 associated with the lifting mechanism 27' can engage the container 35 to be emptied, as is schematically shown at 37. This is conventionally done by positioning the body 2' of the container 35 between the pair of tines 36 so that the tines 36 can engage a pair of brackets 38 associated with the sides of the container 35.

The lifting mechanism 27' is then activated by the operator (remotely, from the cab 30' of the truck 25'), to lift the engaged container 35 to the hopper 26'. This causes the container 35 to proceed along the path 39, until such time as the container 35 is brought to the position 40. In the position 40, the container 35 is again inverted over the hopper 26', with the cover 5' extending downwardly under the influence of gravity. The flag 15 of the signaling assembly 10 will also extend downwardly, under the influence of gravity, keeping the flag 15 free and clear of the refuse which is being discharged from the container 35.

Figure 6B:
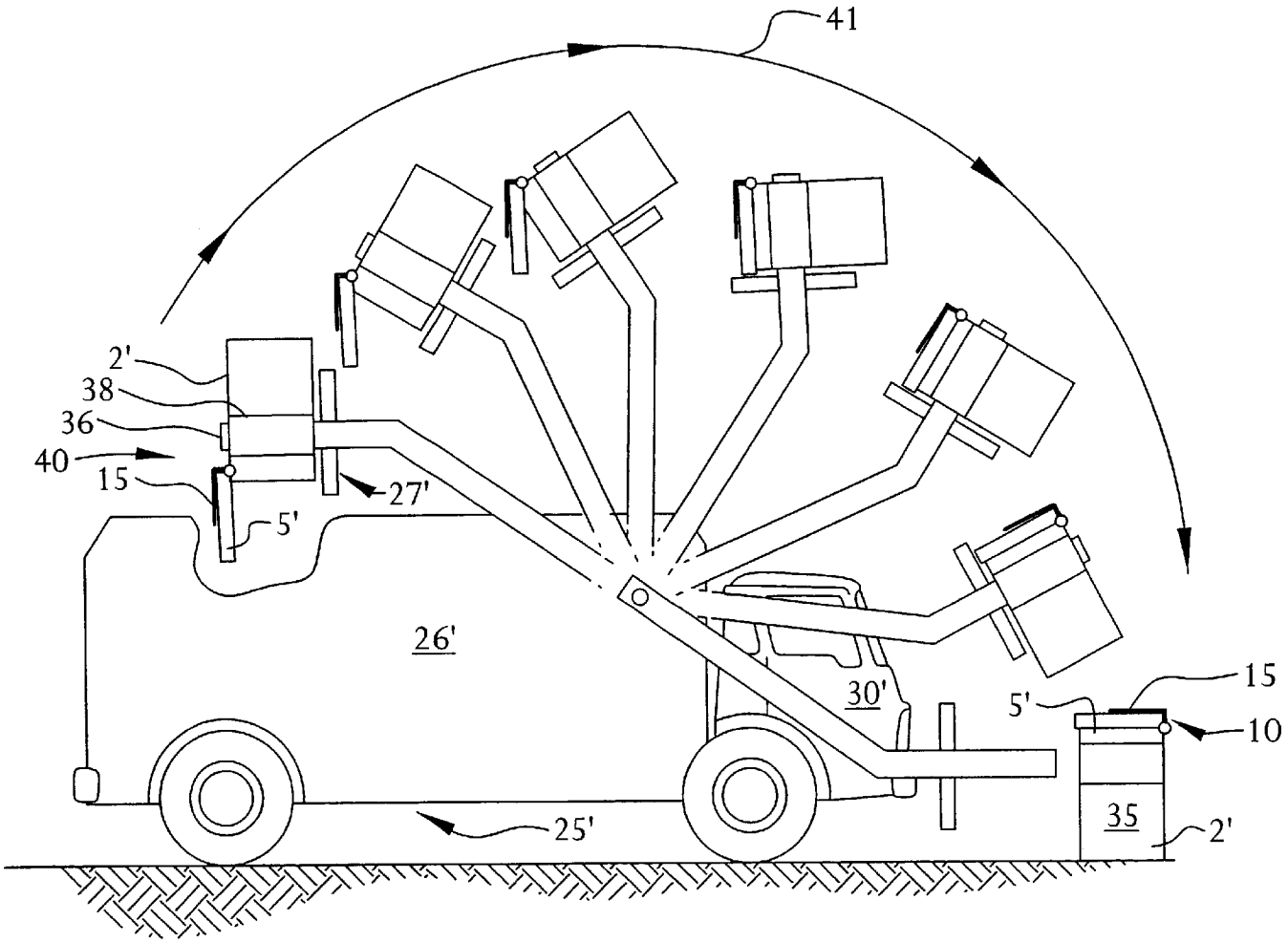

Referring now to FIG. 6B, the emptied container 35 is then returned to its initial position by the lifting mechanism 27'. In the course of this transfer, along the path 41, the cover 5' of the container 35 is caused to return to a position enclosing the opening of the container 35. The configuration of the signaling assembly 10 similarly causes the flag 15 to return to its initial, lowered position (with the flag 15 lying over the cover 5'). Return of the flag 15 to its initial position again takes place automatically, without requiring any intervention by the operator or the subscriber to the refuse removal service. The container 35 is then ready for further use.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus comprising a container and a device for signaling that the container has been accessed, wherein the container includes a body for receiving contents through an opening formed in the container, a cover for enclosing the opening in the body of the container, and a hinged connection for joining the body and the cover so that the cover can rotate relative to the body, and structure for engagement by means for lifting the container to a collection area, and wherein the signaling device comprises:

an attachment assembly which is slidingly coupled with the hinged connection of the container, for engaging portions of the hinged connection so that the attachment assembly can rotate relative to the hinged connection and so that the signaling device can rotate relative to the body and the cover;

a flag extending from the attachment assembly and having a configuration capable of extending over the cover; and a stop extending from the attachment assembly and having a configuration capable of engaging the body of the container;

wherein the flag and the stop are rotatable relative to the cover and the hinged connection, between a lowered position in which the flag is positioned over the cover and the stop is spaced from the body of the container, and a raised position in which the flag is placed in a generally vertical orientation and the stop is in contact with the body of the container, wherein when the container is inverted and subsequently returned to an upright position by the lifting means, gravity will move the flag and the stop from the raised position to the lowered position.

2. The apparatus of claim 1 wherein the hinged connection includes a handle coupled with the cover and a pair of journals extending from the body and engaging opposing ends of the handle.

3. The apparatus of claim 2 wherein the attachment assembly is connected to the handle, for rotation about the handle.

4. The apparatus of claim 1 wherein the attachment assembly includes a first band section having a first curved portion and a second band section having a second curved portion, and wherein the first band section is combined with the second band section so that the first curved portion opposes the second curved portion.

5. The apparatus of claim 4 wherein the first band section has a first mounting bracket coupled with an end of the first curved portion, and wherein the second band section has a second mounting bracket coupled with an end of the second curved portion.

6. The apparatus of claim 5 which further includes attachment means for connecting the first mounting bracket and the second mounting bracket, to combine and form the attachment assembly.

7. The apparatus of claim 5 which further includes a grommet positioned between the hinged connection and the first curved portion of the first band section and the second curved portion of the second band section.

8. The apparatus of claim 7 wherein the grommet is formed of a resilient material.

9. The apparatus of claim 4 wherein the flag extends from the first band section and wherein the stop extends from the second band section.

10. The apparatus of claim 9 wherein the flag and the stop extend from opposing sides of the attachment assembly.

11. The apparatus of claim 9 which further includes an offset connecting the flag and the first band section.

12. The apparatus of claim 9 which further includes an offset connecting the stop and the second band section.

13. The apparatus of claim 11 wherein the attachment assembly rotates about an axis, and wherein the offset connecting the flag and the first band section has a length which positions the flag about 2.5 inches from the axis.

14. The apparatus of claim 11 wherein the flag and the offset are connected to form an angle.

15. The apparatus of claim 14 wherein the angle is an obtuse angle.

16. The apparatus of claim 15 wherein the angle is about 105°.

17. The apparatus of claim 12 wherein the offset radially projects from the attachment assembly for about 0.5 inches.

18. The apparatus of claim 12 wherein the stop and the offset are connected to form an angle.

19. The apparatus of claim 18 wherein the stop projects from the offset at an approximate right angle.

20. A method for signaling that a container has been accessed, wherein the container includes a body for receiving contents through an opening formed in the container, a cover for enclosing the opening in the body of the container, a hinged connection for joining the body and the cover, and structure for engagement by means for lifting the container to a collection area, wherein a signaling apparatus includes an attachment assembly which is coupled with the hinged connection of the container, for engaging portions of the hinged connection so that the attachment assembly can rotate relative to the hinged connection and so that the signaling apparatus can rotate relative to the body and the cover, a flag extending from the attachment assembly and having a configuration capable of extending over the cover, and a stop extending from the attachment assembly and having a configuration capable of engaging the body of the container, and wherein the method comprises the steps of:

slidingly coupling the signaling apparatus with the hinged connection so that the flag and the stop are rotatable relative to the cover and the hinged connection, between a lowered position in which the flag is positioned over the cover and the stop is spaced from the body of the container, and a raised position in which the flag is placed in a generally vertical orientation and the stop is in contact with the body of the container;

raising the cover of the container, engaging the flag and rotating the attachment assembly about the hinged connection so that the flag in the lowered position is engaged by the cover;

automatically rotating the flag, the stop and the attachment assembly relative to the hinged connection, moving the flag from the lowered position to the raised position responsive to movement of the cover, while simultaneously rotating the stop and the attachment assembly relative to the hinged connection, bringing the stop into engagement with the body of the container; and lowering the cover to enclose the opening of the container, while leaving the flag in the raised position, and while leaving the stop in contact with the body of the container, wherein when the container is inverted and subsequently returned to an upright position by the lifting means, gravity will move the flag and the stop from the raised position to the lowered position.

21. A method for signaling that any one of a plurality of subscriber's containers has been accessed and that the accessed container is ready to be emptied, wherein the accessed container includes a body for receiving contents through an opening formed in the accessed container, a cover for enclosing the opening in the body of the accessed container, a hinged connection for joining the body and the cover, and structure for engaging means for lifting the accessed container to a collection area, wherein a signaling apparatus includes an attachment assembly coupled with the hinged connection of the accessed container, for engaging portions of the hinged connection so that the signaling apparatus can rotate about the hinged connection and relative to the body and the cover, a flag extending from the attachment assembly and having a configuration capable of extending over the cover, and a stop extending from the attachment assembly and having a configuration capable of engaging the body of the accessed container, and wherein the method comprises the steps of:

coupling the flag with the hinged connection so that the flag is movable between a lowered position in which the flag is positioned over the cover and the stop is spaced from the body of the accessed container, and a raised position in which the flag is placed in a generally vertical orientation and the stop is in contact with the body of the accessed container;

raising the cover of the accessed container so that the flag in the lowered position is engaged by the cover, automatically moving the flag from the lowered position to the raised position responsive to movement of the cover;

lowering the cover to enclose the opening of the accessed container, while leaving the flag in the raised position; and engaging only the subscriber's containers having a flag in the raised position, wherein when the accessed container is inverted and subsequently returned to an upright position by the lifting means, gravity will move the flag and the stop from the raised position to the lowered position.

22. The method of claim 21 which further includes the step of bypassing the subscriber's containers having a flag in the lowered position.

23. The method of claim 21 which further includes the step of inverting the engaged subscriber's containers over the collection area using the lifting means, and discharging contents of the inverted subscriber's containers into the collection area.

24. The method of claim 23 which further includes the step of returning the inverted subscriber's containers to an upright position, automatically lowering the cover to enclose the opening of the accessed container and automatically returning the flag to the lowered position.

25. The method of claim 24 wherein the automatic lowering and the automatic returning is performed responsive to gravity.

* * * * *